US008858729B2

(12) United States Patent
Buddharaju et al.

(10) Patent No.: US 8,858,729 B2
(45) Date of Patent: Oct. 14, 2014

(54) FLUID FLOW DIVERTER FOR A DISHWASHER APPLIANCE

(75) Inventors: Satish Kumar Raju Buddharaju, Louisville, KY (US); Joel Charles Boyer, Louisville, KY (US); Errin Gnadinger, Louisville, KY (US); Eric B. Devins, Louisville, KY (US)

(73) Assignee: General Electric Company, Schenectady, NY (US)

( * ) Notice: Subject to any disclaimer, the term of this patent is extended or adjusted under 35 U.S.C. 154(b) by 598 days.

(21) Appl. No.: 13/170,481

(22) Filed: Jun. 28, 2011

(65) Prior Publication Data

US 2013/0000762 A1 Jan. 3, 2013

(51) Int. Cl.
*A47L 15/23* (2006.01)
*A47L 15/42* (2006.01)

(52) U.S. Cl.
CPC ..... *A47L 15/4221* (2013.01); *A47L 15/23* (2013.01)
USPC ..... 134/56 D; 134/57 D; 134/58 D

(58) Field of Classification Search
USPC ..... 134/56 D
See application file for complete search history.

(56) References Cited

U.S. PATENT DOCUMENTS

| | | | | |
|---|---|---|---|---|
| 5,429,146 | A * | 7/1995 | Graf et al. | 134/58 D |
| 2007/0295361 | A1 * | 12/2007 | Thiyagarajan et al. | 134/18 |
| 2009/0159103 | A1 | 6/2009 | Gillum et al. | |
| 2010/0139698 | A1 | 6/2010 | Gnadinger et al. | |
| 2010/0139719 | A1 | 6/2010 | Gnadinger et al. | |
| 2011/0056527 | A1 * | 3/2011 | Classen et al. | 134/56 D |

FOREIGN PATENT DOCUMENTS

| | | |
|---|---|---|
| JP | 7250800 | 3/1995 |
| WO | WO 2009077286 A1 * | 6/2009 |

* cited by examiner

*Primary Examiner* — Joseph L Perrin
*Assistant Examiner* — Levon J Shahinian
(74) *Attorney, Agent, or Firm* — Dority & Manning, P.A.

(57) ABSTRACT

The present invention provides a diverter that may be used to control the flow of fluid to different locations or components within a dishwashing appliance. One or more dual outlets, each having an outer port that surrounds an inner port, can be used with rotating disk (or rotating valve) to selectively control the flow of fluid to various locations within the appliance. One or more single outlets may also be added to the diverter as desired depending upon the number of locations in the dishwasher to which the delivery of the fluid is desirable.

18 Claims, 10 Drawing Sheets

FLUID FLOW DIVERTER FOR A DISHWASHER APPLIANCE

FIELD OF THE INVENTION

The present invention relates to a diverter for a dishwashing appliance that can be used to selectively direct the flow of fluid to predetermined locations in the dishwasher.

BACKGROUND OF THE INVENTION

A dishwasher appliance typically has multiple locations at which fluids must be delivered for cleaning and rinsing of dishes, cooking utensils, silverware, or other items placed into the chamber of the dishwasher. For example, the dishwasher may include multiple spray body assemblies such as one under a bottom dishwasher rack and another under the top dishwasher rack. An additional spray device may also be provided over the top dishwasher rack. Some dishwashers may also include a fluid spray specifically for a basket or other compartment that holds silverware. Depending upon the desired steps for a wash or rinse cycle, it may be desirable to control when fluids are provided to particular locations in the dishwasher during a wash or rinse cycle. It may also be desirable to vary the amount of fluid provided at one location relative to another.

Certain applications may also require the ability to switch the delivery of fluid between different locations or components in the dishwasher during a cycle. For example, U.S. patent application Ser. No. 13/103,381, filed on May 9, 2011 and incorporated herein by reference, describes a dishwasher spray assembly having two spray arms. By providing a fluid to only one spray arm at any given time, the flow of fluid from orifices in one spray arm will cause the spray assembly to rotate in a particular direction. Switching to a fluid flow in the other spray arm reverses the direction of rotation of the spray assembly. Accordingly, the direction of rotation of the spray assembly is controlled by switching the flow of water between the different spray arms. The ability to change the direction of rotation during a cycle can improve the cleaning and/or rinsing capability of a dishwasher.

The use of a conventional diverter to switch fluid flow between different locations such as between different spray arms would typically require multiple outlet points and multiple conduits for the delivery of fluid to such different locations. Additional steps in manufacture may also be required to provide such a construction. A conventional diverter can also be inefficient in that it requires additional fluid (e.g., water) during operation because additional volumes must be filled during a wash or rinse cycle.

Accordingly, a diverter for controlling the flow of fluid to multiple, predetermined locations or elements within a dishwasher would be useful. A diverter that can provide for savings in the number of parts and/or steps required for assembly as well as the amount of fluid required for use would also be useful. A diverter that can be used to selectively control the flow of fluid between, for example, the multiple spray arms of one or more spray-arm assemblies such as that shown e.g., in U.S. patent application Ser. No. 13/103,381 would be particularly beneficial.

BRIEF DESCRIPTION OF THE INVENTION

Aspects and advantages of the invention will be set forth in part in the following description, or may be obvious from the description, or may be learned through practice of the invention.

In one exemplary embodiment, the present invention provides a fluid flow diverter for a dishwashing appliance. The diverter has a housing that includes an inlet for the ingress of fluid into the housing and a dual outlet for the egress of fluid from the housing. The dual outlet is formed by an outer port that surrounds and is concentric with an inner port. The outer port provides a separate fluid flow path from the inner port. The diverter also includes a rotatable disk for selectively allowing the flow of fluid from the inlet to either the inner port or the outer port of the dual outlet. The rotatable disk has a plurality of openings for flow through of fluid. A motor is connected with the rotatable disk and configured for turning the rotatable disk so as to align one or more of the plurality of openings of the rotatable disk with the dual outlet.

In another exemplary embodiment, the present invention includes a dishwasher appliance. The dishwasher has a chamber for the receipt of dishes for cleaning and a spray-arm assembly for applying a fluid to the dishes. The spray-arm assembly includes a first spray-arm that causes the spray-arm assembly to rotate in a first direction when fluid is ejected from the first spray arm, and a second spray arm that causes the spray-arm assembly to rotate in a second direction that is opposite to the first direction when fluid is ejected from the second spray arm. The dishwasher includes a diverter for the control of fluid provided to the spray-arm assembly. The diverter has an inlet for the ingress of fluid into the diverter, and a dual outlet for the egress of fluid from the diverter to the spray-arm assembly. The dual outlet includes an outer port and an inner port that provide for separate flows of fluid to the spray-arm assembly. The outer port surrounds the inner port. A rotatable valve is located proximate to the dual outlet. The rotatable valve includes a first opening and a second opening positioned upon the rotatable valve such that either the first opening or second opening can be selectively aligned with the dual outlet to provide for a flow of fluid to either the inner port or the outer port.

In still another exemplary embodiment, the present invention provides a fluid flow diverter for a dishwashing appliance. The diverter includes a housing that has an inlet for the ingress of fluid into the housing and at least two dual outlets for the egress of fluid from the housing. Each dual outlet is formed by an outer port that surrounds and is concentric with an inner port. The outer port provides a separate fluid flow path from the inner port. A rotatable disk is provided for selectively allowing the flow of fluid from the inlet to either the inner port or the outer port of the dual outlets. The rotatable disk has a plurality of openings for the flow through of fluid. A motor is connected with the rotatable disk and configured for turning the rotatable disk so as to align one or more of the plurality of openings of the rotatable disk with the at least two dual outlets.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
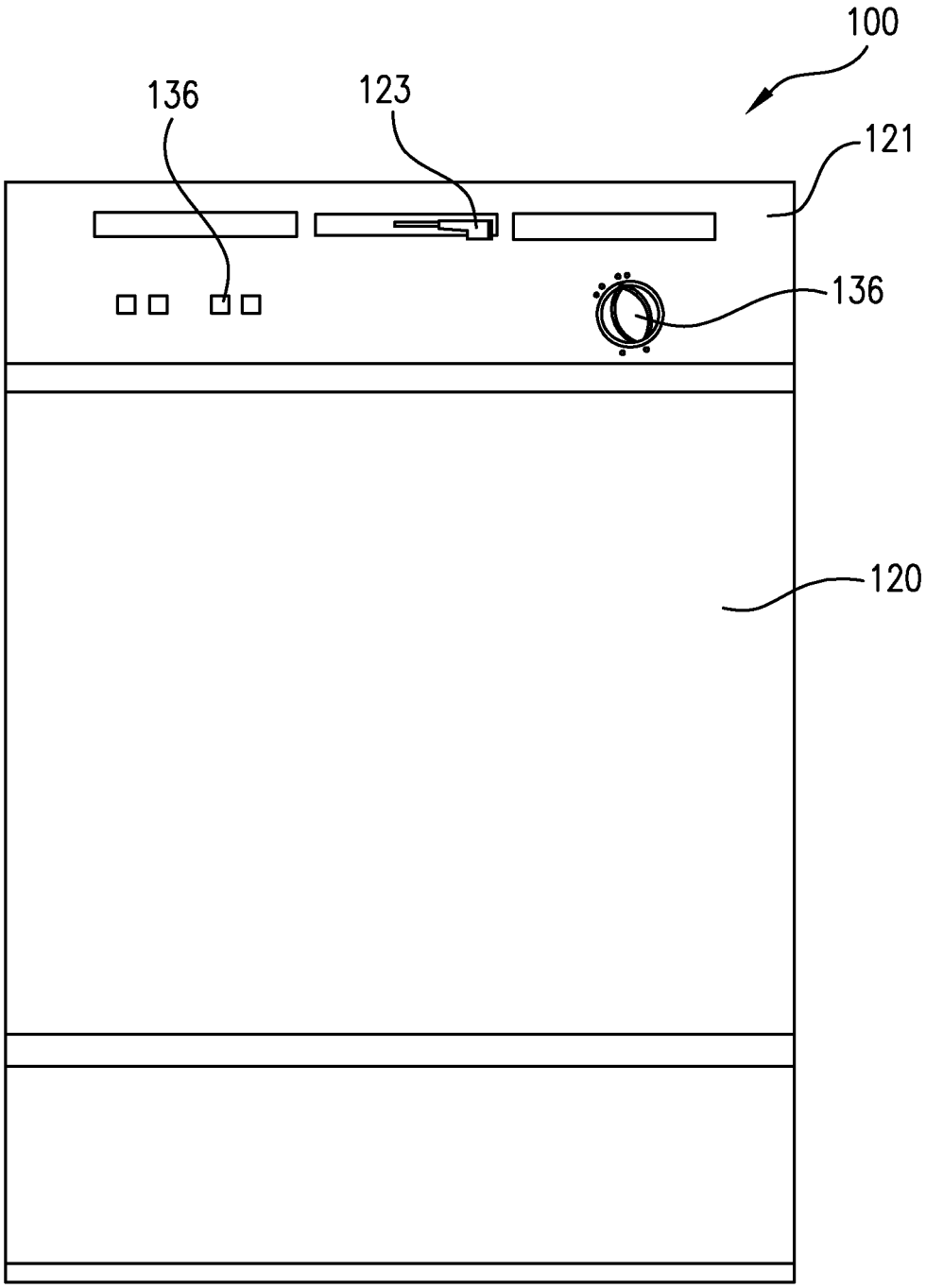
FIG. 1 provides a front, perspective view of an exemplary dishwashing appliance of the present invention.

The present invention provides a diverter that may be used to control the flow of fluid to different locations or components within a dishwashing appliance. One or more dual outlets, each having an outer port that surrounds an inner port, can be used with a rotating disk (or rotating valve) to selectively control the flow of fluid to various locations within the appliance. One or more single outlets may also be added to the diverter as desired depending upon the number of locations in the dishwasher to which the delivery of the fluid is desirable. Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
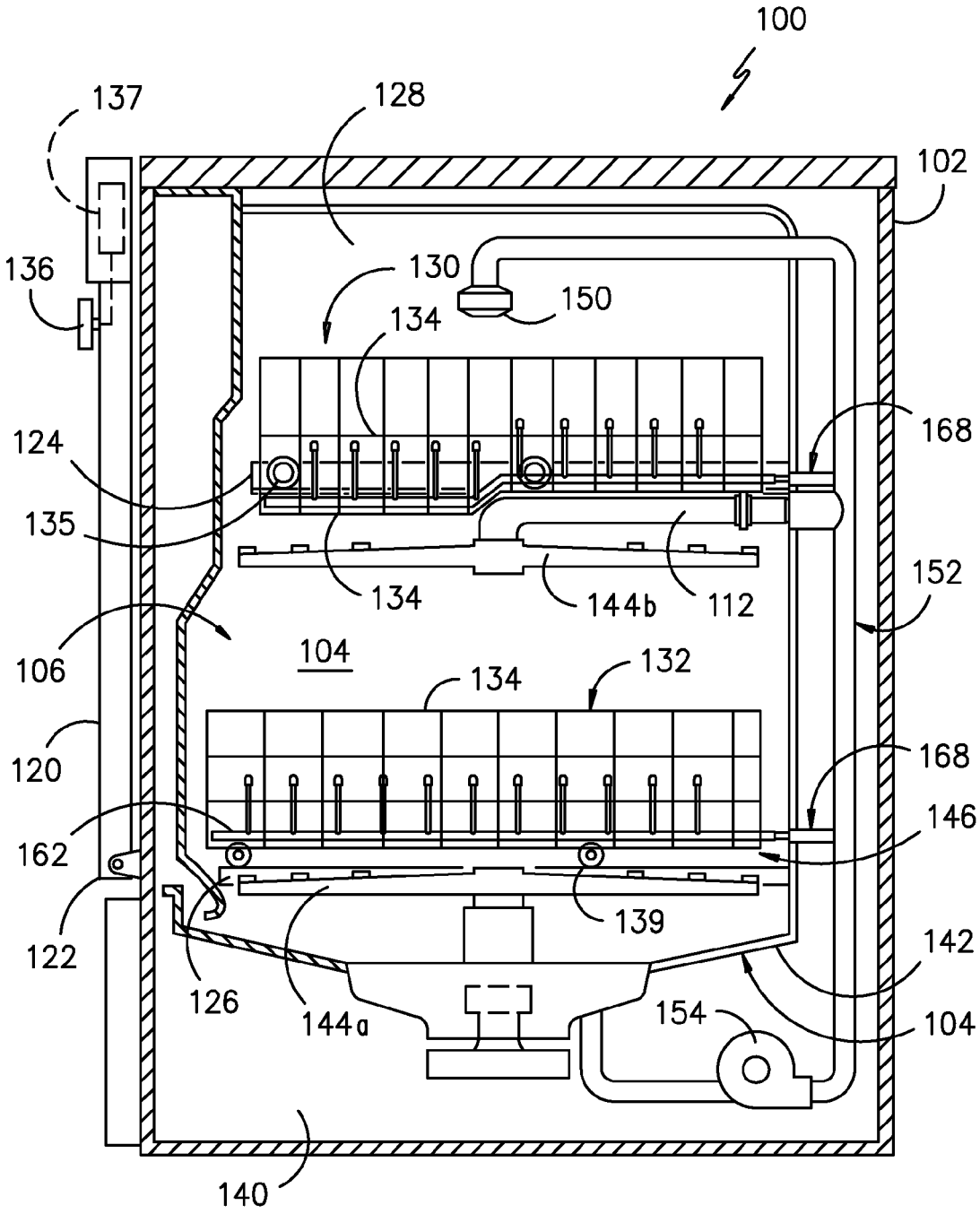
FIG. 2 provides a side, cross-sectional view of the exemplary appliance of FIG. 1.

FIGS. 1 and 2 depict an exemplary domestic dishwasher 100 that may be configured in accordance with aspects of the present disclosure. For the particular embodiment of FIG. 1, the dishwasher 100 includes a cabinet 102 having a tub 104 therein that defines a wash chamber 106. The tub 104 includes a front opening (not shown) and a door 120 hinged at its bottom 122 for movement between a normally closed vertical position (shown in FIGS. 1 and 2), wherein the wash chamber 106 is sealed shut for washing operation, and a horizontal open position for loading and unloading of articles from the dishwasher. Latch 123 is used to lock and unlock door 120 for access to chamber 106.

Upper and lower guide rails 124, 126 are mounted on tub side walls 128 and accommodate roller-equipped rack assemblies 130 and 132. Each of the rack assemblies 130, 132 is fabricated into lattice structures including a plurality of elongated members 134 (for clarity of illustration, not all elongated members making up assemblies 130 and 132 are shown in FIG. 2). Each rack 130, 132 is adapted for movement between an extended loading position (not shown) in which the rack is substantially positioned outside the wash chamber 106, and a retracted position (shown in FIGS. 1 and 2) in which the rack is located inside the wash chamber 106. This is facilitated by rollers 135 and 139, for example, mounted onto racks 130 and 132, respectively. A silverware basket (not shown) may be removably attached to rack assembly 132 for placement of silverware, utensils, and the like, that are otherwise too small to be accommodated by the racks 130, 132.

The dishwasher 100 further includes a lower spray-arm assembly 144*a* that is rotatably mounted within a lower region 146 of the wash chamber 106 and above a tub sump portion 142 so as to rotate in relatively close proximity to rack assembly 132. A mid-level spray-arm assembly 144*b* is located in an upper region of the wash chamber 106 and may be located in close proximity to upper rack 130. Additionally, an upper spray assembly 150 may be located above the upper rack 130.

The lower and mid-level spray-arm assemblies 144*a*, 144*b* and the upper spray assembly 150 are fed by a fluid circulation assembly 152 for circulating water and dishwasher fluid in the tub 104. The fluid circulation assembly 152 may include a pump 154 located in a machinery compartment 140 located below the bottom sump portion 142 of the tub 104, as generally recognized in the art. Each spray-arm assembly 144*a*, 144*b* includes an arrangement of discharge ports or orifices for directing washing liquid onto dishes or other articles located in rack assemblies 130 and 132 as will be further described. The arrangement of the discharge ports in spray-arm assemblies 144*a*, 144*b* provides a rotational force by virtue of washing fluid flowing through the discharge ports. For example, the resultant rotation of the lower spray-arm assembly 144*a* provides coverage of dishes and other dishwasher contents with a washing spray.

The dishwasher 100 is further equipped with a controller 137 to regulate operation of the dishwasher 100. The controller may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

The controller 137 may be positioned in a variety of locations throughout dishwasher 100. In the illustrated embodiment, the controller 137 may be located within a control panel area 121 of door 120 as shown. In such an embodiment, input/output ("I/O") signals may be routed between the control system and various operational components of dishwasher 100 along wiring harnesses that may be routed through the bottom 122 of door 120. Typically, the controller 137 includes a user interface panel 136 through which a user may select various operational features and modes and monitor progress of the dishwasher 100. In one embodiment, the user interface 136 may represent a general purpose I/O ("GPIO") device or functional block. In one embodiment, the user interface 136 may include input components, such as one or more of a variety of electrical, mechanical or electromechanical input devices including rotary dials, push buttons, and touch pads. The user interface 136 may include a display component, such as a digital or analog display device designed to provide operational feedback to a user. The user interface 136 may be in communication with the controller 137 via one or more signal lines or shared communication busses.

It should be appreciated that the invention is not limited to any particular style, model, or other configuration of dishwasher, and that the embodiment depicted in FIGS. 1 and 2 is for illustrative purposes only. For example, instead of the racks 130, 132 depicted in FIG. 1, the dishwasher 100 may be of a known configuration that utilizes drawers that pull out from the cabinet and are accessible from the top for loading and unloading of articles. Other configurations may be used as well.

Figure 3:
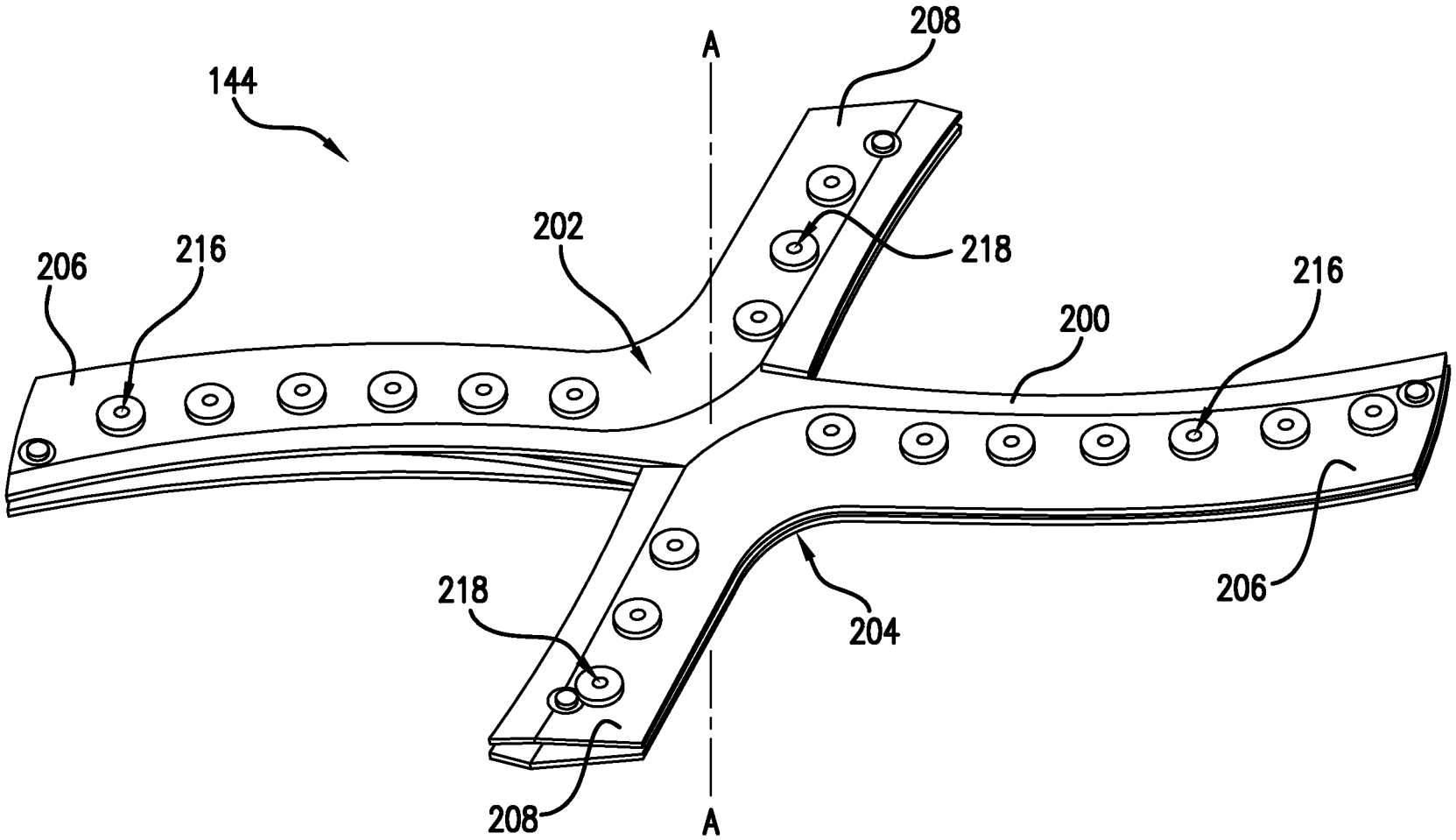
FIG. 3 provides a perspective view of an exemplary spray-arm body or assembly as may be supplied with a fluid using the present invention.
Figure 4:
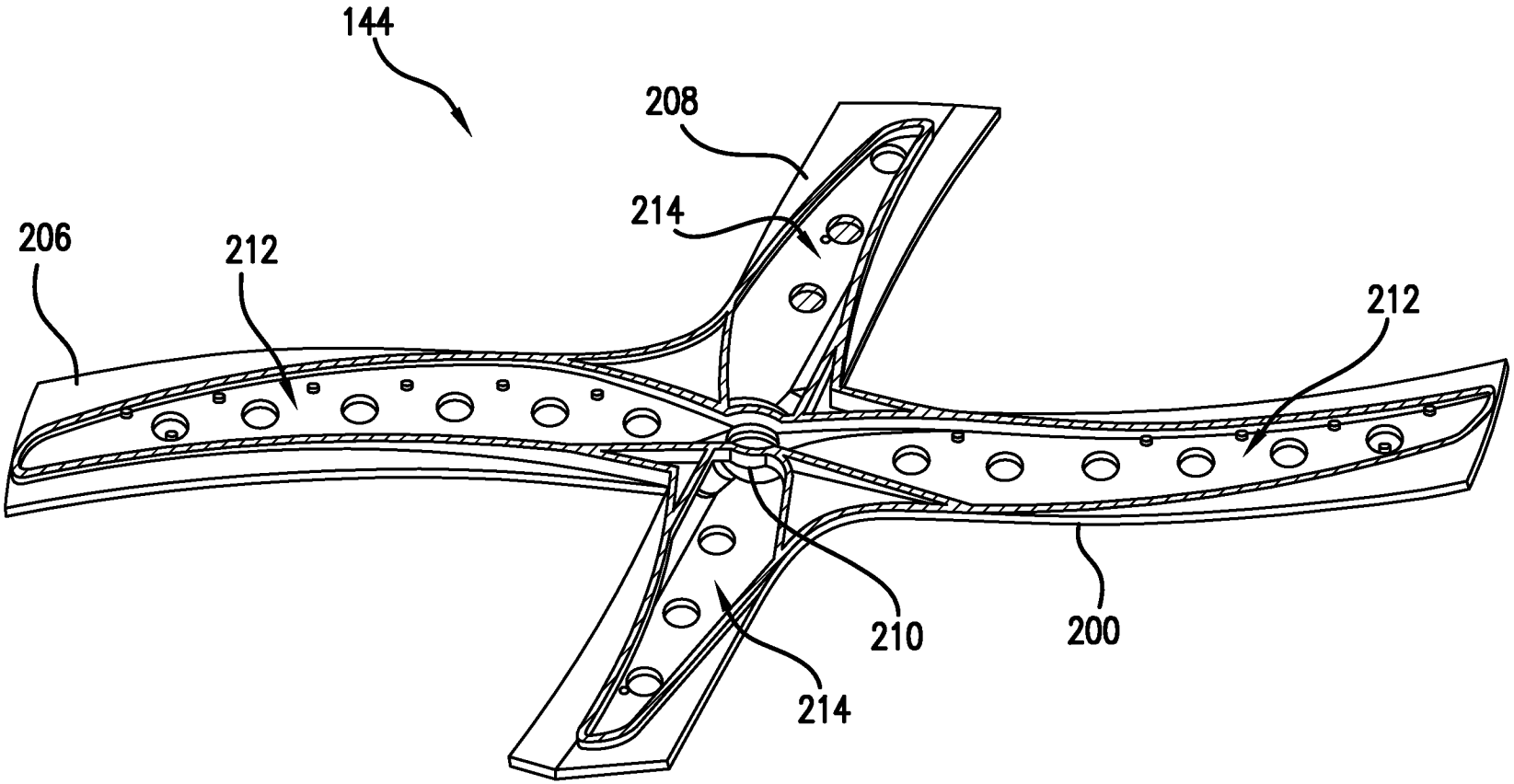
FIG. 4 provides a cross-sectional view of the embodiment of FIG. 3.

FIG. 3 provides an exemplary embodiment of a spray-arm assembly 144 as may be used in dishwasher 100 for spray-arm assembly 144*a* and 144*b*. FIG. 4 provides a cross sectional view of spray-arm assembly 144. As shown, spray-arm assembly 144 includes spray body 200 having top surface 202 and bottom surface 204 (FIG. 3) that generally form two or more spray arms such as first spray arm 206 and second spray arm 208. Each spray arm 206 and 208 is joined into a singular spray body 200 at a common central axis A-A. Each of the spray arms 206 and 208 can have a different sizes and shapes in an effort to gain optimal coverage area in the dishwasher.

Turning to FIG. 4, spray-arm assembly 144 also includes conduit 210 which is coupled with spray body 200 adjacent along central axis A-A. Conduit 210 can be joined in any suitable manner with spray body 200 such that spray body 200 including spray arms 206, 208 can rotate about central axis A-A. For instance, conduit 210 can be rotatably coupled with spray body 200.

Generally, pressurized washing liquid flows through one or more inlets of conduit 210 into spray body 200. Each spray arm 206 and 208 defines a separate and distinct fluid path 212 and 214, respectively, from conduit 210. In turn, fluid paths 212 and 214 provide fluid to one or more orifices 216 and 218, respectively. Orifices 216 and 218 are distributed along spray arms 206 and 208. Orifices 216 and 218 are provided by way of example only. Orifices of other and different arrangements, positioned on both the top and bottom of spray arms 206 and 208, and providing various types of spray patterns may be used with the present invention as well.

The positioning of orifices 216 and 218 are provided so as to impart a rotation of spray arms 206 and 208 about axis A-A. More particularly, upon supplying fluid to orifices 216 in arms 206 without supplying fluid to orifices 218, spray-arm assembly 144 is caused to rotate about axis A-A in particular direction such as e.g., counter-clockwise. Conversely, upon supply fluid to orifices 218 in arms 208 without supplying fluid to orifices 206, spray-arm assembly 144 is caused to rotate in an opposite direction such as e.g., clockwise.

Accordingly, dishwasher 100 is equipped with a device that provides for the selective control of fluid between spray arms 206 and 208 during operation. FIGS. 5 through 10 illustrate an exemplary embodiment of a fluid flow diverter 300 as may be used to direct the flow of fluid between spray arms 206 and 208 as well as between other locations within dishwasher 100 as well. Diverter 300 is preferably located in machinery compartment 140 and can be positioned e.g., below the center of lower spray-arm assembly 144*a*. Diverter 300 can be connected with fluid circulation assembly 152 for providing fluid to lower spray-arm assembly 144*a*, mid-level spray-arm assembly 144*b*, and/or upper spray assembly 150.

Figure 5:
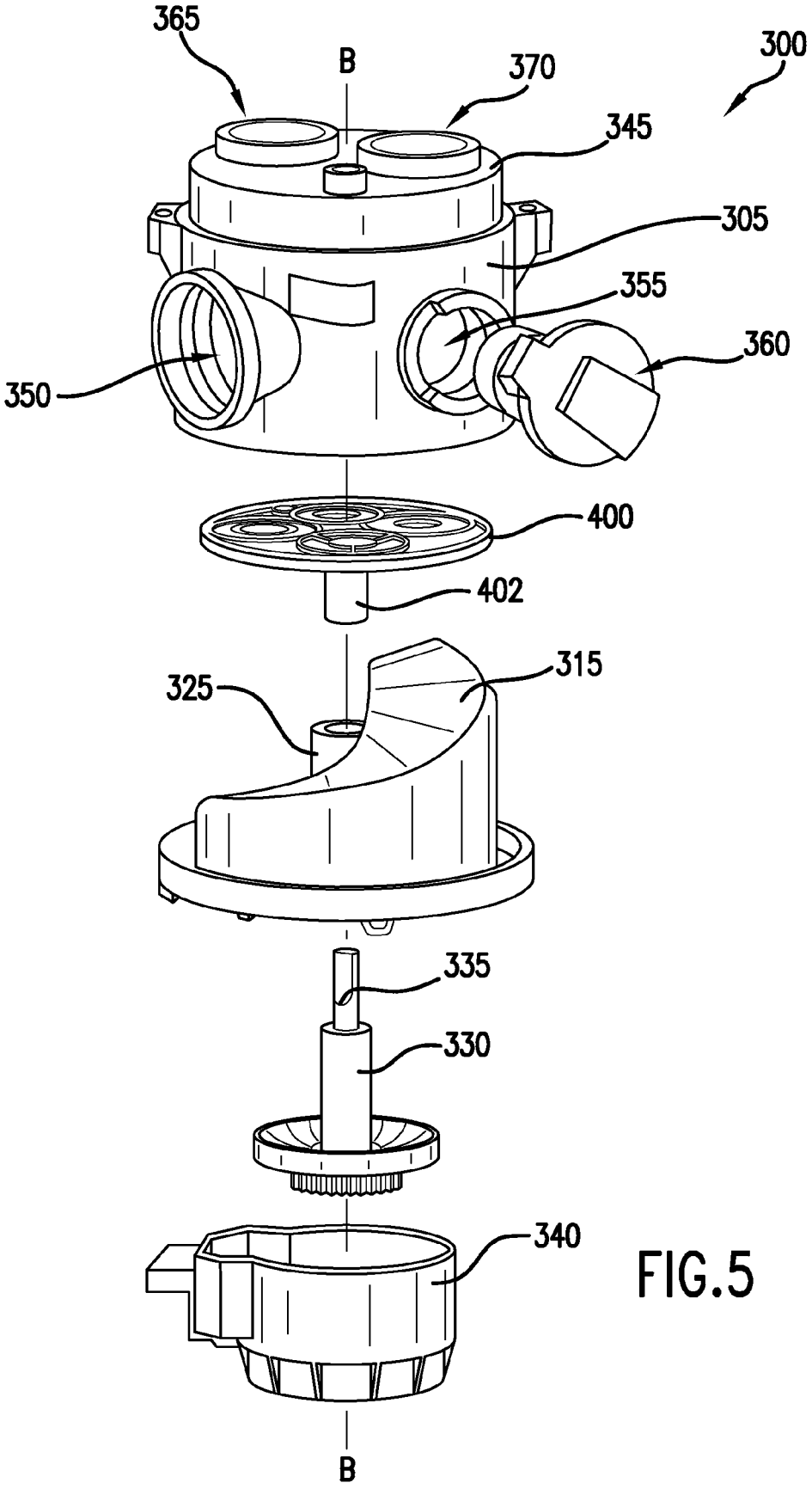
FIG. 5 provides an exploded view of an exemplary embodiment of a diverter of the present invention.

Referring now specifically to FIG. 5, diverter 300 includes a housing 305 into which a rotatable valve or disk 400 is received. A volume reducer 315 is also received into housing 305. Reducer 315 includes a cylinder 325 into which a shaft 402 of disk 400 is rotatable received. A motor 340 is associated with housing 305 and is connected to rotatable disk 400 by a gear driven shaft 330. Shaft 330 includes a stem 335 that is received into shaft 402 of disk 400, Accordingly, motor 340 can be used to selectively rotate disk 400 to various positions as will be further described. housing 305 also defines an inlet 350 for the ingress of fluid such as water or water containing detergent or rinse additives. An opening 355 is also provided for the receipt of a pressure sensor 360 for use in determining the pressure of fluid in housing 305. A variety of other shapes and configurations may be used for housing 305—it being understood that the particular embodiment for housing 305 that is shown in the figures is by way of example only.

Figure 6:
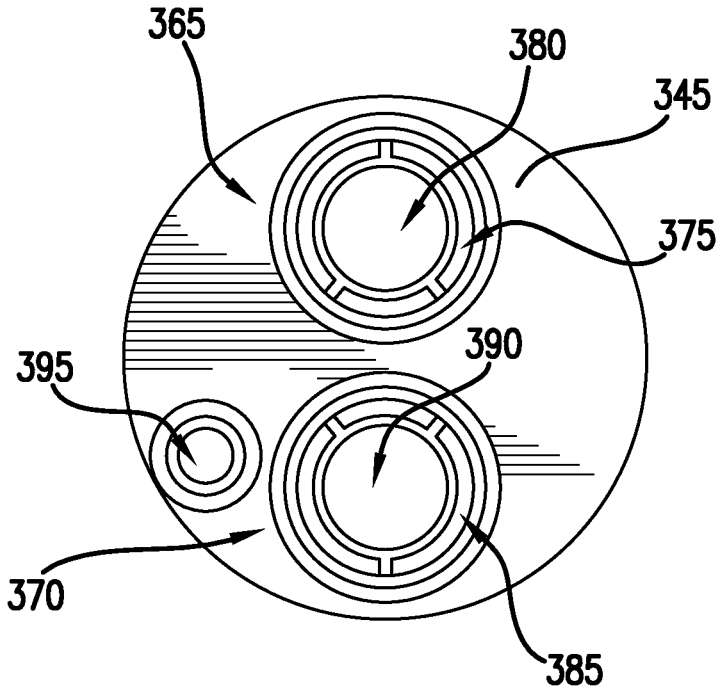
FIG. 6 provides a top view of only the top portion of the exemplary diverter shown in FIG. 5. The other components of the diverter, such as the rotatable disk and other components shown in FIG. 5, are not depicted in FIG. 6.

As shown in FIG. 6, the housing 305 of diverter 300 includes a top portion 345 that includes a first dual outlet 365 and a second dual outlet 370. First dual outlet 365 is formed by an outer port 375 that surrounds and is concentric with an inner port 380. Outer port 375 and inner port 380 provide for two separate flows of fluid from housing 305. Similarly, second dual outlet 370 is formed by an outer port 385 that surrounds and is concentric with inner port 390. Outer port 385 and inner port 390 provide for two separate flows of fluid from housing 305. A single outlet 395 is also defined by top portion 345 of housing 305. Unlike the dual outlets, single outlet 395 provides for a single flow of fluid from housing 305. For purposes of description of the invention, diverter 300 is shown with two dual outlets 365 and 370, Using the teachings disclosed herein, it will be understood that embodiments of the present invention can also include a diverter having a single dual outlet or more than two dual outlets as well. In addition, while only one single outlet 395 is shown, embodiments of the present invention can include multiple single outlets or no single outlets as desired. Finally, various combinations of one or more dual outlets may be combined with one or more single outlets as well.

The flow of fluid through dual outlets 365 and 370 and single outlet 395 is controlled by the selective rotation of disk 400 using motor 340. As will be described, disk 400 includes a plurality of openings that can be aligned with outlets 365, 370, and 395 to provide for the selection of fluid flow to various locations or components within dishwasher 100. For example, disk 400 may be rotated to selectively provide for the flow of fluid to either spray arm 206 or spray arm 208 of spray body assembly 144 so as to control its direction of rotation.

Figure 7:
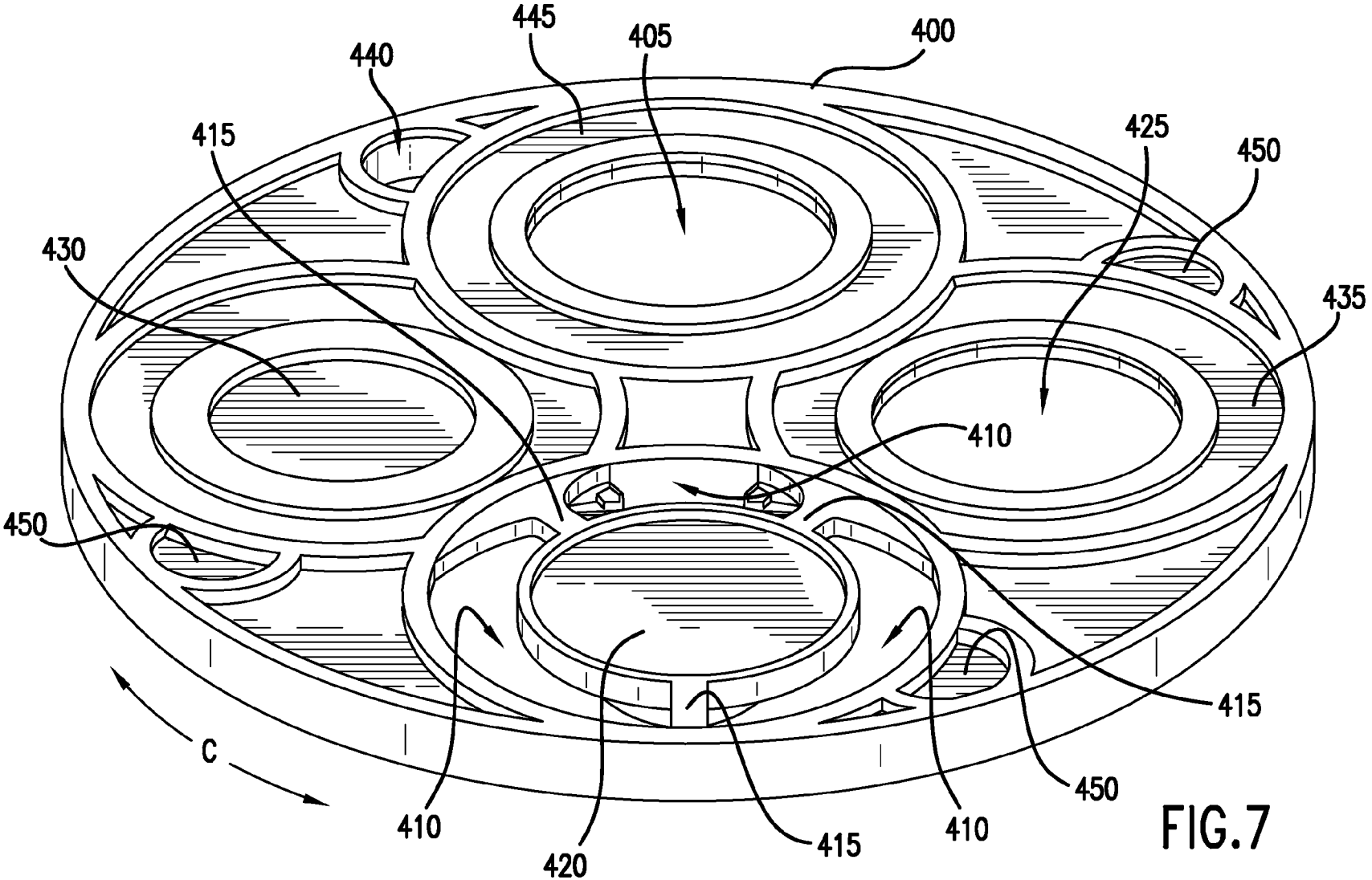
FIG. 7 provides an exemplary embodiment of a rotatable disk as may be used with the present invention.

More particularly, FIG. 7 provides a perspective view of an exemplary embodiment of disk 400. As shown, disk 400 includes a first opening 405 that substantially matches the size and shape of the inner port 380 of dual outlet 365 and the inner port 390 of dual outlet 370. Disk 400 also includes a second opening 410 (interrupted by bridges 415) that substantially matches the size and shape of the outer port 375 of dual outlet 365 and the outer port 385 of dual outlet 370. Also included with disk 400 is a third opening 425 that also substantially matches the size and shape of the inner port 380 of dual outlet 365 and the inner port 390 of dual outlet 370. Finally, disk 400 also includes a fourth opening 440 that substantially matches the size and shape of single outlet 395. The plurality of openings 405, 410, 425, and 440 can be selectively positioned by rotation of disk 400 along circumferential direction C and about axis B-B (FIG. 5) so as to allow for fluid flow through disk 400 and out of the housing 305 of diverter 300 as will be further described.

Second opening 410 surrounds a block 420 that matches the size and shape of inner port 380 and inner port 390 and can be used to block or cover either port. Block 430 matches the size and shape of all ports of dual outlets 365 and 370 and can be used to completely block or cover either of such outlets. Opening 425 is surrounded by a block 435 that matches the size and shape of outer ports 375 and 385 and can be used to block either of the same. Similarly, opening 405 is surrounded by a block 445 that matches the size and shape of outer ports 375 and 385 and can be used to block either of the same. The plurality of blocks 420, 430, 435, and 445 can be selectively positioned by rotation of disk 400 so as to block the flow of fluid through disk 300 and out of housing 405 as will be further described.

Disk 400 is provided by way of example only. Using the teachings disclosed herein, one of ordinary skill in the art will understand that the present invention includes embodiments of disks configured with different numbers of blocks and openings spaced along circumferential direction C as well as different positions thereof depending upon, for example, the construction of the outlets in the top portion 345 of housing 305. By way of further example, disk 400 could be constructed with only openings 405 and 410 and block 420 so as to provide for the control of fluid flow through a dual outlet such as dual outlet 365 or dual outlet 370. Other construction may also be used.

Accordingly, FIGS. 8 through 11 illustrate how the selective positioning of disk 400 using motor 340 determines the flow of fluid out of diverter 300. In FIGS. 8 through 11, the cross-hatching indicates a blocked port while the absence of cross-hatching indicates an open port depending upon the position selected for disk 400. More specifically, the positioning of disk 400 controls where fluid entering through inlet 350 may exit diverter 300. The selective control of flow through one or more of the ports of dual outlets 365 and 370 or single outlet 395 is based on the alignment of openings 405, 410, 425, and/or 440 with such outlets. In turn, by connecting single outlet 395 and the ports of dual outlets 365 and 370 with different elements or locations within dishwasher 100, the flow of fluid can be selected or diverted as desired thereto.

By way of example, inner port 380 can be connected so as to provide fluid to the first arm 206 of lower spray-arm assembly 144*a* while outer port 375 can be connected to provide fluid to the second arm 208 of lower spray-arm assembly 144*a*. Similarly, inner port 390 can be connected to provide fluid to the first arm 206 of mid-level spray-arm assembly 144*b* while outer port 385 can be connected to provide fluid to the second arm 208 of mid-level spray-arm assembly 144*b*. Single outlet 395 can be connected with e.g., upper spray assembly 150, a nozzle for a silverware basket, or other location(s) within dishwasher 100.

Figure 12:
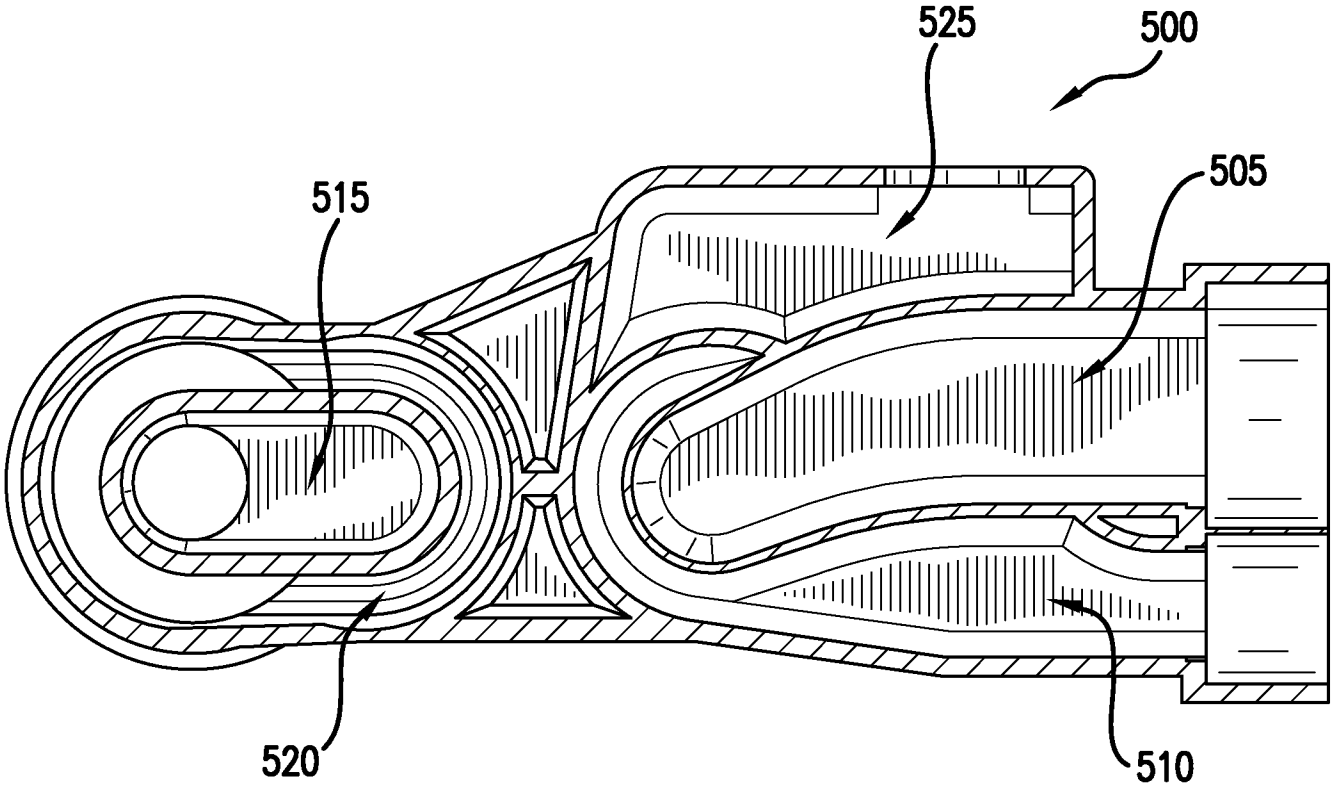
FIG. 12 provides a view of the inside of an exemplary embodiment of a manifold as may be attached to the top portion of the exemplary diverter shown in FIG. 5.

FIG. 12 provides an example of a manifold 500 that may be connected with the top portion 345 of the housing 305 of diverter 300 to help provide the connection with single outlet 395 and the ports of dual outlets 365 and 370. As shown, manifold 500 has an inner flow path 505 that is positioned with inner port 380 for receiving fluid therefrom and an outer flow path 510 that is positioned with outer port 375 for receiving fluid from the same. Similarly, inner flow path 515 is positioned with inner port 390 for receiving fluid therefrom and outer flow path 520 is positioned with outer port 385 for receiving fluid from the same, Manifold 500 also includes an auxiliary flow path 525 for the positioning with single outlet 395 and receiving fluid from the same. Thus, manifold 500 can be used to route fluid flow as selectively controlled by diverter 300 to various locations within dishwasher 100.

Figure 8:
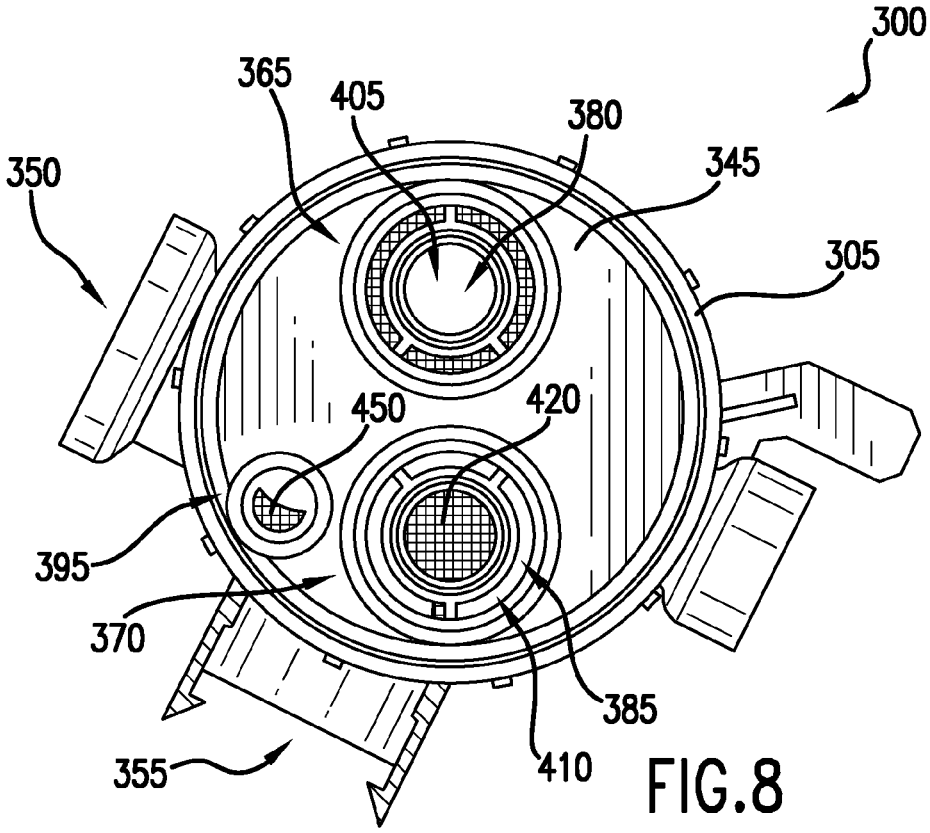
FIGS. 8 through 11 provide top views of the diverter of FIGS. 5 and 6 with cross hatching used to show portions of the rotatable disk depicted in FIGS. 5 and 7. The rotatable disk is shown in a different position in each of FIGS. 8 through 11.

For example, in FIG. 8, disk 400 is positioned such that opening 405 is aligned with inner port 380 while opening 410 is aligned with outer port 385, Ports 375 and 390 as well as single outlet 395 are blocked in this position by blocks 445, 420, and 450, respectively. As such, when disk 400 is in the position shown for FIG. 8, fluid is provided to the first arm 206 of lower spray-arm assembly 144*a* and to the second arm 208 of the mid-level spray-arm assembly 144*b*.

Figure 9:
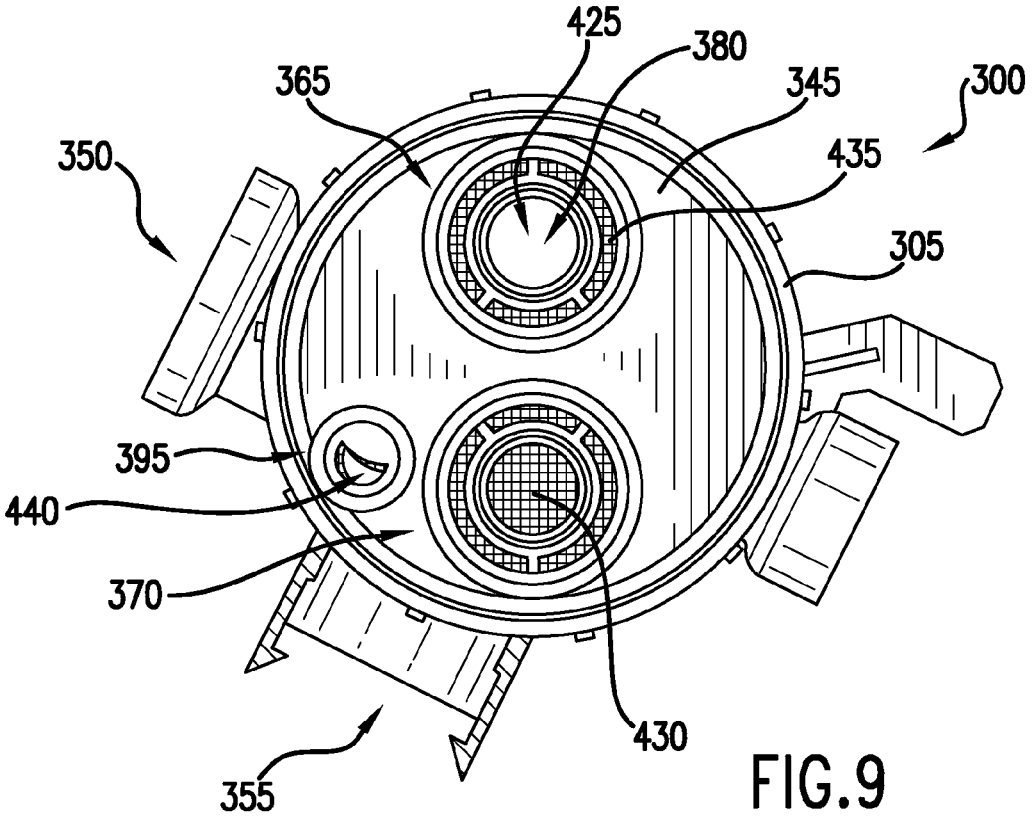

In FIG. 9, disk 400 has been rotated counter-clockwise. Opening 425 is aligned with inner port 380 and opening 440 is aligned with single outlet 395. Dual outlet 370 is closed by block 430 and outer port 375 is closed by block 435. Accordingly, in this position, diverter 300 allows fluid to flow to the first arm 206 of lower spray arm assembly 144*a* and to spray arm 150, a silverware basket, or other location that is connected with single outlet 395.

Figure 10:
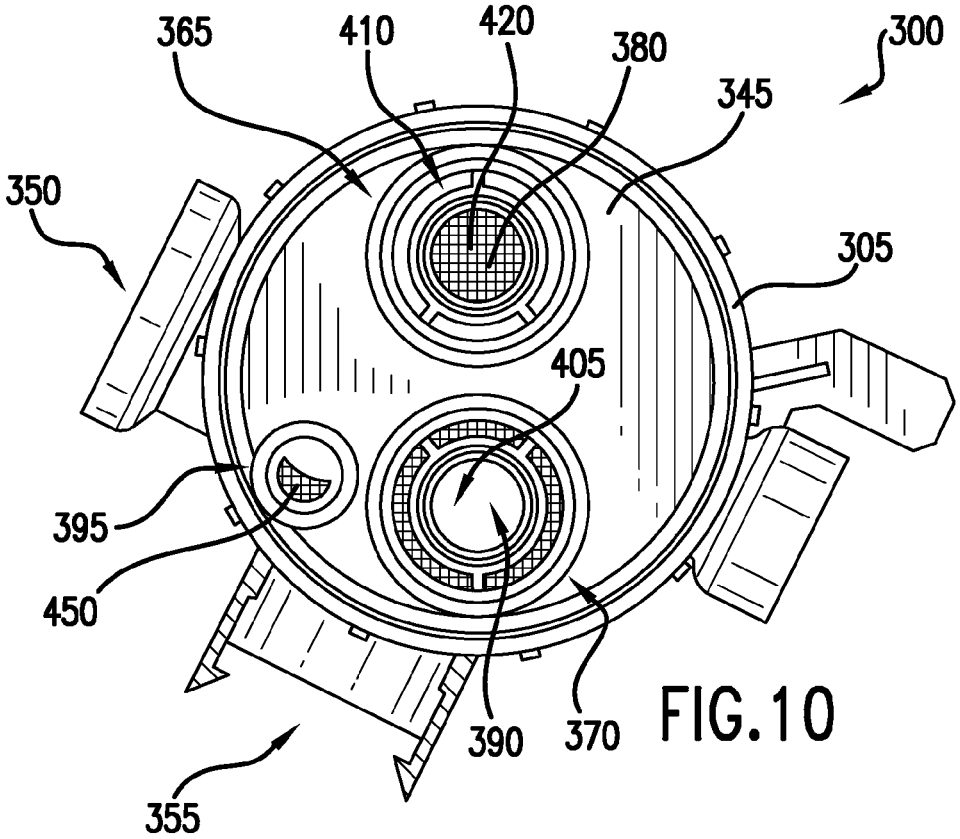

Disk 400 has been rotated counter-clockwise again in FIG. 10. As shown, opening 405 is aligned with inner port 390 and opening 410 is aligned with outer port 375. Single outlet 395 is blocked along with inner port 380 and outer port 385. In this position, fluid is allowed to flow to the first arm 206 of mid-level spray arm assembly 144*b* and to the second arm 208 of lower spray-arm assembly 144*a*.

Figure 11:
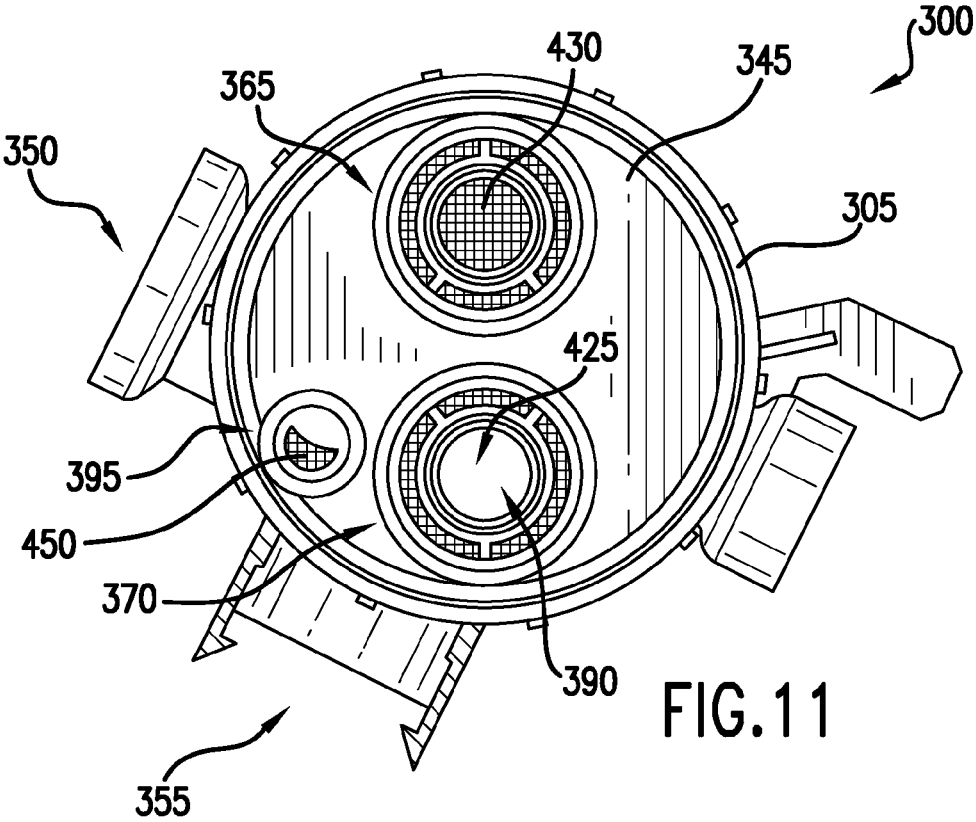

FIG. 11 represents another counter-clockwise rotation of disk 400. Here, dual outlet 365 and single outlet 395 are both closed. Opening 425 is aligned with inner port 390. Accordingly, fluid is allowed to flow to first-arm 206 of the mid-level spray-arm assembly 144*b* in this position.

FIGS. 8-11 are provided by way of example only. Other configurations may be used to supply fluid to spray-arm assemblies 144*a* and 144*b* as well to spray arm 150 (or other elements connected with single outlet 395). The use of spray-arm assemblies 144*a* and 144*b* are also provided by way of example only. Diverter 300 may be used to selectively control the flow of fluid to other locations in dishwasher 100 as well.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A fluid flow diverter for a dishwashing appliance, comprising:

a housing that includes:

an inlet for the ingress of fluid into the housing;

a dual outlet for the egress of fluid from the housing, the dual outlet formed by an outer port that surrounds and is concentric with an inner port, the outer port providing a separate fluid flow path from the inner port;

a rotatable disk for selectively allowing the flow of fluid from the inlet to either the inner port or the outer port of the dual outlet, said rotatable disk having a plurality of openings for flow through of fluid; and, a motor connected with said rotatable disk and configured for turning said rotatable disk so as to align one or more of the plurality of openings of said rotatable disk with the dual outlet.

2. A fluid flow diverter for a dishwashing appliance as in claim 1, wherein the plurality of openings of said rotatable disk comprises:

a first opening that substantially matches the size and shape of the inner port of the dual outlet; and, a second opening that substantially matches the size and shape of the outer port of the dual outlet.

3. A fluid flow diverter for a dishwashing appliance as in claim 2, further comprising a block that is surrounded by the second opening, said block matching the size and shape of the inner port so as to preclude the flow of fluid through the inner port when the second opening is aligned with the outer port.

4. A fluid flow diverter for a dishwashing appliance as in claim 3, wherein said housing further comprises a single outlet for the egress of fluid from the housing, and wherein the plurality of openings of said rotatable disk further comprises a third opening that can be aligned with the single outlet of said housing by rotation of said rotatable disk.

5. A fluid flow diverter for a dishwashing appliance as in claim 4, the dishwashing appliance having a spray body assembly having a first spray-arm and a second spray-arm, and wherein the inner port of the dual outlet can be placed in fluid communication with said first spray-arm by rotation of said rotatable disk, and wherein the outer port of the dual outlet can be placed in fluid communication with the second spray-arm by rotation of said rotatable disk.

6. A fluid flow diverter for a dishwashing appliance as in claim 3, the dishwashing appliance having a spray arm assembly having a first spray-arm and a second spray-arm, and wherein the inner port of the dual outlet can be placed in fluid communication with said first spray-arm by rotation of said rotatable disk, and wherein the outer port of the dual outlet can be placed in fluid communication with the second spray-arm by rotation of said rotatable disk.

7. A fluid flow diverter for a dishwashing appliance as in claim 3, wherein the first opening and the second opening are spaced apart along a circumferential direction of the rotatable disk.

8. A dishwasher appliance, comprising:

a chamber for the receipt of dishes for cleaning;

a spray-arm assembly for applying a fluid to the dishes, the spray-arm assembly comprising a first spray-arm that causes the spray-arm assembly to rotate in a first direction when fluid is ejected from the first spray-arm;

a second spray arm that causes the spray-arm assembly to rotate in a second direction that is opposite to the first direction when fluid is ejected from the second spray arm;

a diverter for the control of fluid provided to said spray-arm assembly, said diverter comprising:

an inlet for the ingress of fluid into said diverter;

a dual outlet for the egress of fluid from said diverter to said spray-arm assembly, the dual outlet comprising an outer port and an inner port that provide for separate flows of fluid to said spray-arm assembly, and wherein the outer port surrounds the inner port; and a rotatable valve located proximate to the dual outlet, said rotatable valve comprising a first opening and a second opening positioned upon said rotatable valve such that either the first opening or second opening can be selectively aligned with said dual outlet to provide for a flow of fluid to either the inner port or the outer port.

9. A dishwasher appliance as in claim 8, further comprising a motor in mechanical communication with said rotatable valve and configured for selectively rotating said rotatable valve for positioning of the first opening and the second opening relative to the dual outlet.

10. A dishwasher appliance as in claim 9, said rotatable valve having an axis of rotation, and further comprising a drive shaft connecting said motor and said rotatable valve along the axis of rotation.

11. A dishwasher appliance as in claim 8, wherein said diverter further comprises a single outlet for the egress of fluid from said diverter, and wherein said rotatable valve further comprises a third opening that can be aligned with the single outlet for providing a flow of fluid to a predetermined position in the dishwasher appliance.

12. A dishwasher appliance as in claim 8, wherein said diverter further comprises a volume reducer positioned inside said diverter and configured for reducing the amount of fluid that can be contained within said diverter.

13. A dishwasher appliance as in claim 8, further comprising a block that is surrounded by the second opening, said block matching the size and shape of the inner port so as to preclude the flow of fluid through the inner port when the second opening is aligned with the outer port.

14. A dishwasher appliance as in claim 13, wherein said diverter further comprises a single outlet for the flow of fluid to a predetermined location in the dishwasher, and wherein said rotatable valve further comprises a third opening that can be aligned with the single outlet of said diverter to connect the inlet of said diverter with the single outlet.

15. A dishwasher appliance as in claim 8, further comprising a manifold connected to said diverter, said manifold comprising an inner flow path and an outer flow path for providing fluid to predetermined locations within the dishwasher appliance, wherein said inner flow path is fluidly connected with said inner port and said outer flow path is fluidly connected with said outer port.

16. A dishwasher appliance as in claim 8, further comprising a pressure sensor attached to said diverter and configured for measuring fluid pressure in said diverter.

17. A dishwasher appliance as in claim 8, wherein the inner port of the dual outlet is connected to provide fluid to the first spray-arm and the outer port is connected to provide fluid to the second spray-arm.

18. A fluid flow diverter for a dishwashing appliance, comprising:

a housing that includes an inlet for the ingress of fluid into the housing;

at least two dual outlets for the egress of fluid from the housing, each dual outlet formed by an outer port that surrounds and is concentric with an inner port, the outer port providing a separate fluid flow path from the inner port;

a rotatable disk for selectively allowing the flow of fluid from the inlet to either the inner port or the outer port of the dual outlets, said rotatable disk having a plurality of openings for flow through of fluid; and, a motor connected with said rotatable disk and configured for turning said rotatable disk so as to align one or more of the plurality of openings of said rotatable disk with said at least two dual outlets.

* * * * *